US007942188B2

(12) United States Patent
Skelley, Jr. et al.

(10) Patent No.: US 7,942,188 B2
(45) Date of Patent: May 17, 2011

(54) REFRACTORY METAL CORE

(75) Inventors: Richard Albert Skelley, Jr., Massillon, OH (US); Richard Lee Kreske, Mentor, OH (US)

(73) Assignee: Vent-Tek Designs, LLC, Eastlake, OH (US)

( * ) Notice: Subject to any disclaimer, the term of this patent is extended or adjusted under 35 U.S.C. 154(b) by 586 days.

(21) Appl. No.: 12/046,589

(22) Filed: Mar. 12, 2008

(65) Prior Publication Data

US 2009/0229780 A1 Sep. 17, 2009

(51) Int. Cl.
*B22C 9/10* (2006.01)

(52) U.S. Cl. ..... 164/28; 164/361; 164/369

(58) Field of Classification Search ..... 164/28, 164/361, 369, 516–519
See application file for complete search history.

(56) References Cited

U.S. PATENT DOCUMENTS

| | | | |
|---|---|---|---|
| 4,025,226 | A | 5/1977 | Hovan |
| 5,332,537 | A | 7/1994 | Hens et al. |
| 5,344,283 | A | 9/1994 | Magowan et al. |
| 5,374,161 | A | 12/1994 | Kelch et al. |
| 5,375,973 | A | 12/1994 | Sloop et al. |
| 5,405,242 | A | 4/1995 | Auxier et al. |
| 5,486,090 | A | 1/1996 | Thompson et al. |
| 5,599,166 | A | 2/1997 | Deptowicz et al. |
| 5,645,397 | A | 7/1997 | Soechting et al. |
| 5,770,136 | A | 6/1998 | Huang |
| 5,989,476 | A | 11/1999 | Lockard et al. |
| 6,153,312 | A | 11/2000 | Schmidt et al. |
| 6,637,500 | B2 | 10/2003 | Shah et al. |
| 6,668,906 | B2 | 12/2003 | Burd |
| 6,913,064 | B2 | 7/2005 | Beals et al. |
| 6,929,054 | B2 | 8/2005 | Beals et al. |
| 6,951,239 | B1 | 10/2005 | Snyder et al. |
| 7,014,424 | B2 | 3/2006 | Cunha et al. |
| 2004/0020629 | A1 | 2/2004 | Shah et al. |
| 2005/0087319 | A1 | 4/2005 | Beals et al. |
| 2006/0018780 | A1 | 1/2006 | Hosamani et al. |

*Primary Examiner* — Jessica L Ward
*Assistant Examiner* — Kevin E Yoon
(74) *Attorney, Agent, or Firm* — Tarolli, Sundheim, Covell & Tummino LLP

(57) ABSTRACT

A cast metal article, such as a turbine engine component, is made by shaping a body of refractory metal particles to form a molded refractory metal article. The molded refractory metal article is sintered to form a refractory metal core. Both the refractory metal article and a setter block may be sintered at the same time. At least a portion of the refractory metal core is enclosed with wax. The wax is at least partially enclosed with a covering of mold material. The wax is removed from the mold material to form an article mold cavity. The article mold cavity is filled with molten metal which solidifies to form a cast metal article. The refractory metal core is removed from the cast metal article.

49 Claims, 3 Drawing Sheets

REFRACTORY METAL CORE

BACKGROUND OF THE INVENTION

The present invention relates to a new and improved method of making an improved core which is used to form space in a cast metal article.

Cores are commonly utilized to form space within a cast metal article. Known cores have been formed from ceramic materials such as silica. In U.S. Pat. Nos. 6,637,500 and 6,929,054 it is suggested that a core may include a ceramic element and a refractory metal element which is attached to the ceramic element. Cores formed of ceramic or of ceramic and refractory metal elements may be utilized in the casting of metal articles, such as turbine engine components.

SUMMARY OF THE INVENTION

The present invention provides a new and improved method of making cast metal articles utilizing new and improved refractory metal cores. In practicing the method, a body of refractory metal particles is shaped to form a one piece molded refractory metal article having a configuration which is a function of a desired configuration of a space in the cast metal article. The molded refractory metal article is sintered to form a refractory metal core which is integrally formed as one piece.

When the molded refractory metal article is to be sintered, the molded refractory metal article may advantageously be positioned on a setter block which is formed by shaping a body of refractory metal particles. While the refractory metal article is disposed on the refractory metal setter block, both the setter block and the molded refractory metal article are sintered to form a refractory metal core which is disposed on the sintered setter block.

The integrally formed one piece refractory metal core is positioned in a mold cavity having a configuration corresponding to the desired configuration of the metal article to be cast. Molten metal is poured into the article mold cavity and solidified to form the cast metal article. The refractory metal core is removed from the cast metal article.

It is contemplated that the refractory metal core may be utilized to form space in many different types of cast metal articles. These cast metal articles may include turbine engine components. The turbine engine components may be blades or vanes. Alternatively, the turbine engine component may be part of a casing. For example, the turbine engine component may be a blade outer air seal. Of course, the refractory metal core may be utilized to cast articles other than components of turbine engines.

BRIEF DESCRIPTION OF THE DRAWINGS

The foregoing and other features of the invention will become more apparent upon consideration of the following description taken in connection with the accompanying drawings wherein.

DESCRIPTION OF SPECIFIC PREFERRED EMBODIMENTS OF THE INVENTION

General Description

Figure 1:
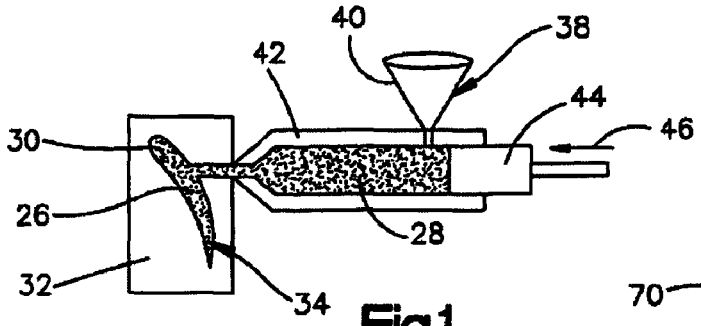
FIG. 1 is a schematic illustration depicting the manner in which a body of refractory metal particles is molded to form a refractory metal article.

A method of making a cast metal article 20 (FIG. 9) in which a space 22 is disposed is illustrated schematically in FIGS. 1 through 8. A body 26 (FIG. 1) of refractory metal particles 28 is shaped in a core mold cavity 30 in a die 32 to form an integrally molded one piece refractory metal article 34. An injection molding apparatus 38 is utilized to fill the core mold cavity 30 with refractory metal particles 28.

The injection molding apparatus 38 (FIG. 1) has a known construction and includes a hopper 40 which directs refractory metal particles 28 into a barrel 42. A piston 44 is moved in the direction of an arrow 46 to force the refractory metal particles 28 from the barrel 42 into the core mold cavity 30 in the die 32. The pressure applied against the refractory metal particles 28 by the injection molding apparatus 38 causes the particles to adhere together to form the integrally molded one piece refractory metal article 34.

The injection molding apparatus 38 may have a different construction if desired. For example, a screw may be utilized to force refractory metal particles 28 into the core mold cavity 30 in the die 32. Of course, the core mold cavity 30 may be filled with refractory metal particles 28 in a different way if desired. For example, the die 32 may have an open core mold cavity into which metal particles are pressed.

The refractory metal particles 28 have an average particle size of ten (10) to twenty (20) microns with the smallest particle having a particle size of less than one (1) micron. The refractory metal particles 28 are mixed with a suitable binder before being moved into the hopper 40. The binder coats the refractory metal particles 28 and enables them to adhere to each other. The binder also promotes flow of the refractory metal particles 28 into recesses formed in the core mold cavity 30.

Although many different binders may be utilized, one specific binder which may be utilized is a finely ground thermoplastic which is commercially available from AFT, a division of Precision Cast Parts Corporation, having a place of business at 7040 Weld County Road 20, Longmont, Colo. 80504. Of course, other known binders may be utilized if desired.

The refractory metal particles 28 (FIG. 1) are capable of withstanding relatively high temperatures. The refractory metal particles 28 may be formed of molybdenum, tungsten, tantalum, and/or niobium metal and mixtures or alloys and intermetallics of these metals. In the embodiment of FIG. 1, the refractory metal particles 28 are particles of molybdenum.

The refractory metal (molybdenum) particles 28 are forced into the core mold cavity 30 with sufficient force to have the particles adhere to each other to make an integrally molded one piece refractory metal article 34. The integrally molded one piece refractory metal article 34 may be referred to as a green core. The integrally molded one piece refractory metal article 34 has a configuration which is a function of the desired configuration of the space 22 (FIG. 9) in the cast metal article 20.

Figure 2:
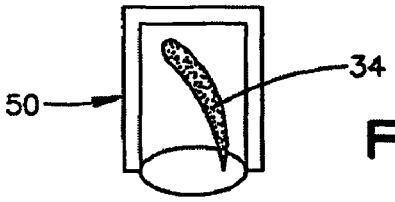
FIG. 2 is a schematic illustration depicting the manner in which a binder is removed from the molded refractory metal article of FIG. 1.

The one piece molded refractory metal article 34 (FIG. 1) is moved from the die 32 to a solvent debinding apparatus 50 (FIG. 2). While the one piece molded refractory metal article 34 is in the solvent debinding apparatus 50, the binder is removed from the one piece molded refractory metal article 34 without disrupting the refractory metal particles 28. The debinding apparatus immerses the one piece molded refractory metal article 34 in a fluid that dissolves the binder. The solvent may be heated.

One specific solvent which may be utilized in the apparatus 50 to remove the binder is trichloroethylene. Alternatively, methyl ethyl ketone or freon may be used as the solvent. It is believed that heating the one piece molded refractory metal article 34 may promote removal of the binder from the article. It should be understood that any one of many different known methods of debinding may be utilized to remove the binder from the one piece molded refractory metal article 34.

Figure 3:
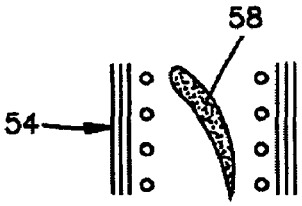
FIG. 3 is a schematic illustration depicting the manner in which the molded refractory metal article of FIGS. 1 and 2 is sintered to form a refractory metal core.

Once the one piece molded refractory metal article 34 has been debound, it is moved from the solvent debinding apparatus 50 (FIG. 2) to a sintering furnace 54 (FIG. 3). In the sintering furnace 54, the one piece molded refractory metal article 34 is sintered to form an integrally formed one piece refractory metal core 58. During sintering, the refractory metal particles 28 bond together to form the one piece refractory metal core 58.

On a microstructural scale, the bonding occurs as cohesive necks (weld bonds) grow at points of contact between the refractory metal particles 28. To achieve bonding between the refractory metal particles 28 during sintering, the one piece molded refractory metal article 34 is heated to a temperature above 2,200° F. in the sintering furnace 54. If desired, the one piece molded refractory metal article 34 may be positioned on a setter block during sintering.

Due to bonding together of the refractory metal particles 28 during sintering, there is shrinkage of the one piece molded refractory metal article 34 (FIG. 2) as it is sintered in the sintering furnace 54 (FIG. 3). The shrinkage of the one piece molded refractory metal article 34 during sintering is between twenty percent (20%) and sixty percent (60%). If desired, a setter block may be utilized to minimize deformation of the one piece molded refractory metal article 34 as it shrinks. Shrinkage of the one piece molded refractory metal article 34 enables relatively fine details to be obtained on the integrally molded one piece refractory metal core 58.

The refractory metal forming the core 58 (FIG. 3) tends to oxidize and/or erode when exposed to hot molten metals during a casting process. To minimize any tendency for the integrally molded one piece refractory metal core 58 to oxidize and/or erode during exposure to molten metal, a protective coating is applied to the integrally molded one piece refractory metal core. The protective coating may be applied by utilizing a chemical vapor deposition apparatus 62 (FIG. 4) having a known construction.

The chemical vapor deposition apparatus 62 applies a thin continuous coating to the integrally molded one piece refractory metal core 58. This coating may be formed of silica. Alternatively, the coating may be formed of alumina, zirconia, chromia, mullitc, or hafnia.

It should be understood that a mixture of coating materials, including a mixture of the foregoing ceramic materials, may be utilized to provide the erosion and oxidation resistant coating on the integrally molded one piece refractory metal core 58. It should also be understood that the coating may be applied to the integrally molded one piece refractory metal core 58 by methods other than chemical vapor deposition. For example, electrophoresis or other techniques may be utilized to apply the coating to the integrally molded one piece refractory metal core 58.

Figure 5:
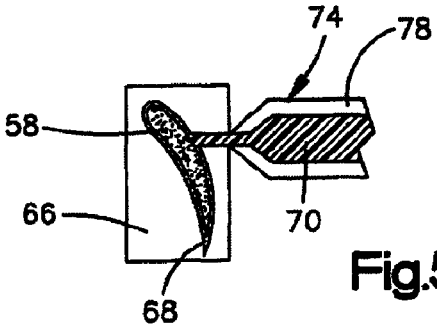
FIG. 5 is a schematic illustration depicting the manner in which the refractory metal core of FIGS. 3-4 is at least partially enclosed with wax.
Figure 6:
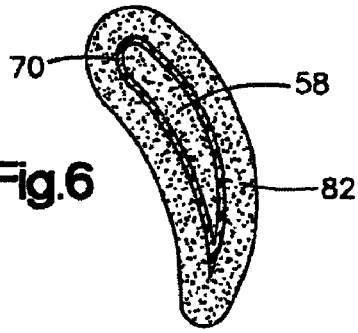
FIG. 6 is a schematic illustration depicting the manner in which the wax enclosed core of FIG. 5 is covered with mold material.

Once the protective coating has been applied to the integrally molded one piece refractory metal core 58, the core is positioned in a wax injection mold or die 66 (FIG. 5). The wax injection mold 66 has a wax mold cavity 68 with a configuration which corresponds to the desired configuration of the cast metal article 20. The integrally molded one piece refractory metal core 58 is at least partially spaced from side surfaces of the wax mold cavity 68. The wax 70 is forced from a wax injection molding apparatus 74 into the wax mold cavity 68. The wax 70 extends around and at least partially encloses the integrally molded one piece refractory metal core 58. The wax 70 may be either a natural or a synthetic wax.

The wax injection molding apparatus 74 may have a construction similar to the construction of the injection molding apparatus 38 of FIG. 1. The wax injection molding apparatus 74 (FIG. 5) includes a barrel 78 from which wax is forced into the wax mold cavity 68. The wax 70 encloses at least a portion of the integrally molded one piece refractory metal core 58. The covering of wax 70 around the integrally molded one piece refractory metal core 58 has a configuration corresponding to the desired configuration of the cast metal article 20.

When the integrally molded one piece refractory metal core 58 has been enclosed by the wax 70, the core, with the covering of wax thereon, is removed from the wax injection mold 66. A covering 82 of a suitable mold material is applied over the wax 70 and integrally molded one piece refractory metal core 58 in the manner illustrated schematically in FIG. 6. The covering 82 of mold material solidifies over the outside of the wax 70.

The covering 82 (FIG. 6) of mold material may be a ceramic mold material which encloses the wax 70 and the core 58. Although may different types of ceramic mold material may be utilized to form the covering 82, one illustrative covering contains fused silica, zircon, and refractory materials in combination with binders. It should be understood that the covering 82 of mold material may have any one of many known compositions.

Once the covering 82 of mold material has been applied over the wax 70, the wax is removed from the covering of mold material. This may be done by heating the covering 82 of mold material, wax 70, and core 58. Removing the wax 70 from the covering 82 of mold material forms an article mold cavity 86 (FIG. 7) having the same configuration as the wax 70. Since the wax 70 has a configuration which corresponds to the desired configuration of the cast metal article 20 (FIG. 9), the article mold cavity 86 (FIG. 7) also has a configuration which corresponds to the desired configuration of the cast metal article 20.

Molten metal 90 (FIG. 8) is then poured into the article mold cavity 86. The molten metal 90 extends around the core 58 and fills the article mold cavity 86. The molten metal 90 may have any desired composition. For example, the molten metal 90 may be a nickel chrome super alloy or titanium.

Figure 9:
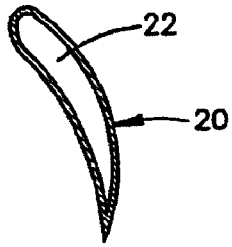
FIG. 9 is a schematic illustration of a cast metal article formed by solidification of the molten metal in the mold cavity of FIGS. 7 and 8 and removal of the refractory metal core.

The molten metal 90 is solidified to form the cast metal article 20 (FIG. 9). When the molten metal 90 has solidified, the covering of mold material 82 is removed from around the cast metal article 20. In addition, the core 58 is removed from within the cast metal article 20. The core 58 may be removed by acid treatment or other known methods.

The space 22 (FIG. 9) formed in the cast metal article 20 by removal of the core 58 has a configuration corresponding to the configuration of the core. Since the integrally molded one piece refractory metal core 58 is relatively strong, it may be utilized to form an intricate space 22 within the cast metal article 20. The space 22 within the cast metal article may have fine details.

Both the cast metal article 20 and space 22 may have any one of many different configurations, for example, the space 22 may have a plate-like configuration. Due to the strength and accuracy with which the integrally molded one piece refractory metal core 58 is formed, a space 22 having a plate-like configuration may have a width of 0.5 inches to eight inches or more and a length of two to thirty inches. A plate-like space 22 having these dimensions may have portions with a thickness of twelve thousandths of an inch (0.012 of an inch) or less. Of course, the thickness of at least part of the space 22 may be greater than the foregoing twelve thousandths of an inch (0.012 of an inch).

It is also contemplated that the thickness of the space 22 may be different at different locations along the length and width of the space. Thus, the space 22 may not have a uniform thickness throughout the extent of the space and may have different thicknesses at different locations along the length and width of the space. Of course, the space 22 may have a uniform thickness if desired.

It should be understood that the foregoing specific dimensions and configurations for the space 22 have been set forth herein as being representative of many possible dimensions and configurations of the space 22. It is contemplated that the cast metal article 20 will be cast with a space 22 having dimensions and/or a configuration different than the specific dimensions and configurations set forth herein.

The integrally molded one piece refractory metal core 58 (FIG. 3) has a size and configuration which corresponds to the desired size configuration of the space 22 (FIG. 9). The integrally molded one piece refractory metal core 58 may have either flat or undulating major side surfaces. Major side surfaces of the flat or undulating portion of the integrally molded one piece refractory metal core 58 may be formed either with or without projections. The surfaces of the integrally molded one piece refractory metal core 58 may have openings or may be free of openings.

If the cast metal article 20 is to be formed with a plurality of internal support portions, openings may be formed in the refractory metal core 58. The openings in the core 58 will have sizes and configurations corresponding to the desired sizes and configurations of the support portions. If the openings in the core 58 are formed with a circular configuration to form the cast metal article 22 with cylindrical internal support portions, the openings in the core 58 may have a diameter which is one-fourth (¼) or less of the thickness of the portion of the integrally molded one piece refractory metal core 58 in which the openings are formed. The openings may be three thousandths of an inch (0.003) or less in diameter. The openings may be separated by a distance which is equal to or less than the diameter of the openings.

If the cast metal article 20 is to be formed with a plurality of holes or openings in a surface area on the cast metal article 20, projections may be formed on the refractory metal core 58. The projections on the core 58 may have any desired size and configuration corresponding to the desired size and configuration of the holes or openings in the cast metal article 20. If the cast metal article 20 is to have both internal support portions and surface openings, the refractory metal core 58 would be formed with a combination of openings and projections. The location, size and configuration of the openings and projections on the refractory metal core would be determined by the specific design of the cast metal article 20.

The space 22 in a cast metal article 20 may be a passage for conducting a flow of fluid, that is, either a liquid or a gas. Alternatively, the space 22 may be filled with a fluid and sealed. Of course, the space 22 within the cast metal article 20 may be used for many purposes other than the conducting or holding of fluid. For example, the space 22 may receive a solid body or a particulate material.

The cast metal article 20 illustrated in FIG. 9 has a cross sectional configuration which is similar to the cross sectional configuration of an airfoil. However, it should be understood that the cast metal article 20 may have any desired configuration. The specific configuration illustrated in FIG. 9 should be considered as merely being representative of many different configurations with which the cast metal article 20 may be formed.

For example, the cast metal article 20 may have a polygonal configuration. Alternatively, the cast metal article 20 may have a cylindrical configuration. If desired, the cast metal article 20 may be formed with different portions having different configurations. Thus, one portion of the cast metal article 20 may have a polygonal configuration while another portion of the cast metal article has a cylindrical configuration.

The space 22 in the cast metal article 20 has a cross sectional configuration which is generally similar to the cross sectional configuration of the cast metal article. However, the space within the cast metal article may have a configuration which is different than the configuration of the cast metal article. For example, the cast metal article 20 may have a polygonal configuration and the space 22 may have a cylindrical configuration. Alternatively, the cast metal article 20 may have a cylindrical configuration and the space 22 may have a polygonal configuration.

Airfoil

Figure 10:
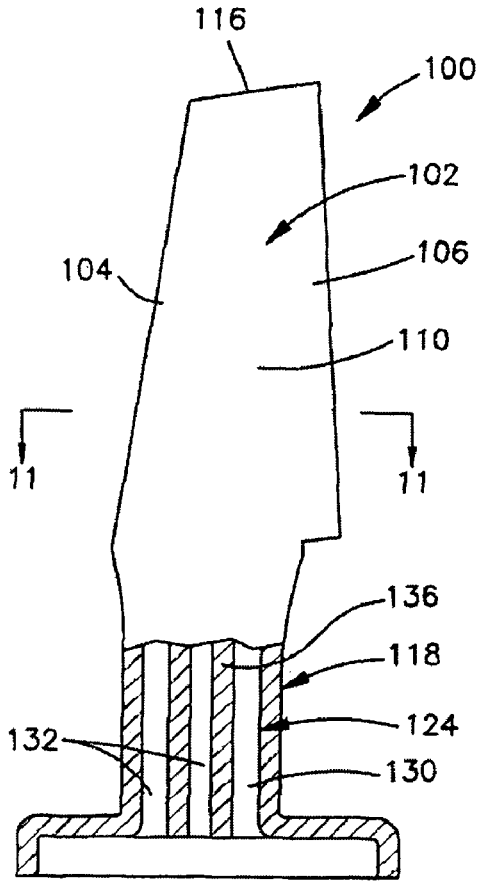
FIG. 10 is an enlarged schematic plan view of a metal blade which is cast with a refractory metal core formed and utilized in the manner illustrated schematically in FIGS. 1-8.

An airfoil for use in a turbine engine is illustrated schematically in FIG. 10 and is cast with a refractory metal core formed and utilized in the manner illustrated in FIGS. 1-8. The airfoil is a cast metal blade 100. However, the airfoil may be a vane.

The blade 100 has a known construction and includes an airfoil portion 102 (FIGS. 10 and 11) which interacts with a flow of air or other fluid. The airfoil portion 102 has a leading edge portion 104 and a trailing edge portion 106. A connector portion 108 (FIG. 11) extends between the leading edge portion 104 and trailing edge portion 106.

A concave major side surface 110 (FIG. 11) is disposed on the connector portion 108 and extends between the leading and trailing edge portions 104 and 106. A convex major side surface 112 is disposed on the opposite side of the connector portion 108. The convex major side surface 112 extends between the leading edge portion 104 and trailing edge portion 106.

The blade 100 has an upper (as viewed in FIG. 10) or tip end portion 116. The blade 100 has a lower (as viewed in FIG. 10) base or root portion 118. The blade 100 is hollow.

Figure 11:
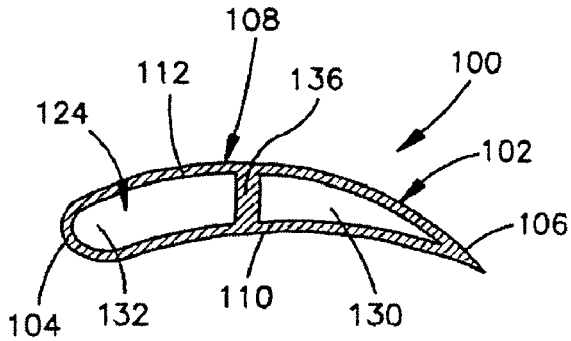
FIG. 11 is a schematic sectional view, taken generally along the line 11-11 of FIG. 10, illustrating the configuration of an airfoil portion of the blade.

The hollow blade 100 is integrally cast as one piece of metal. The metal forming the blade 100 is a nickel chrome super alloy. The blade 100 has an inner space which forms a cooling fluid flow passage 124 (FIGS. 10 and 11). The cooling fluid flow passage 124 has a fluid inlet portion 130 (FIG. 10) in the base or root portion 118. In addition, the cooling fluid flow of passage 124 has a fluid outlet portion 132 in the base or root portion 118.

A divider 136 (FIG. 11) is integrally formed as one piece with the metal blade 100. The divider 136 separates the fluid inlet portion 130 of the fluid flow passage 124 from the fluid outlet portion 132 of the fluid flow passage. The divider 136 stops short of the tip end portion 116 (FIG. 1). Therefore, the inlet portion 130 of the fluid flow passage 124 is connected with the outlet portion 132 of the fluid flow passage in a region close to the tip end portion 116 of the blade 100.

Although the concave and convex major side surfaces 110 and 112 have been illustrated in FIGS. 10 and 11 as being free of openings through which cooling fluid may flow, it is contemplated that openings may be provided in the concave and convex major side surfaces to enable fluid to flow from the passage 124 to outer side surface areas of the blade 100. A slot may be provided in the trailing edge portion 106 to accommodate cooling fluid flow if desired. It should be understood that the illustrated blade 100 is a schematic representation of many different blades 100 having many known different cooling fluid flow passages 124. The blade 100 and its cooling flow of passage 124 are merely representative of a vast number of different blade designs having different cooling fluid flow passage designs.

Figure 13:
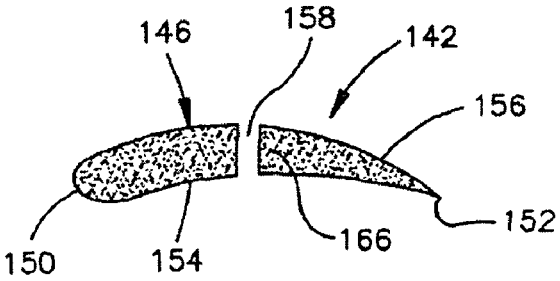
FIG. 13 is a sectional view, taken along the lines 13-13 of FIG. 12, further illustrating the construction of the refractory metal core.

An integrally molded one piece refractory metal core 142 (FIGS. 12 and 13) is utilized to form the cooling fluid flow passage 124 (FIGS. 10 and 11) in the blade 100. The integrally molded one piece refractory metal core 142 was formed by a process which is the same as the process described herein in connection with FIGS. 1-4. The integrally molded one piece refractory metal core 142 was formed of molybdenum particles. However, a different refractory metal may be utilized if desired.

The integrally molded one piece refractory metal core 142 (FIG. 12) has a main portion 146 which forms the portion of the cooling fluid flow of passage 124 (FIGS. 10 and 11) disposed in the airfoil portion 122 of the blade 100. In addition, the integrally molded one piece refractory metal core 142 (FIG. 12) has a base portion 148 which forms the portion of the cooling fluid flow passage 124 disposed in the base or root portion 118 of the blade 100 (FIG. 10).

Figure 12:
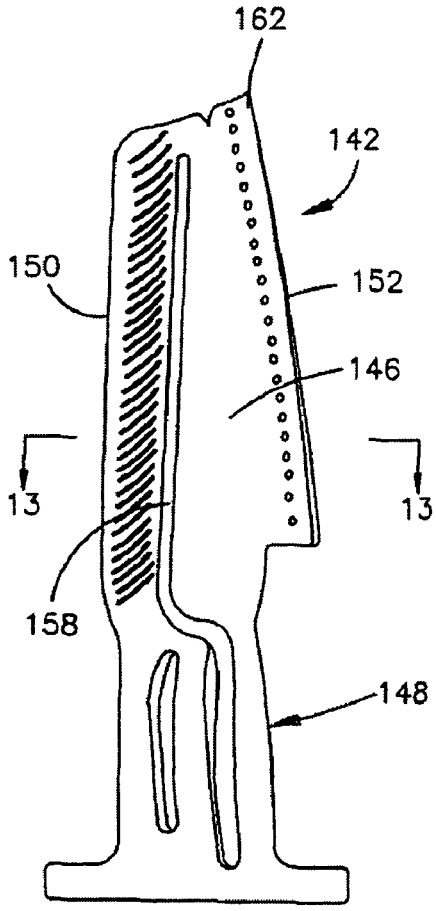
FIG. 12 is a schematic plan view, generally similar to FIG. 10, of a refractory metal core which is formed in the manner illustrated schematically in FIGS. 1-4 and utilized to form an airflow passage in the blade of FIGS. 10 and 11.

The integrally molded one piece refractory metal core 142 has been schematically illustrated in FIG. 12 as having a general configuration corresponding to the general configuration of the cooling fluid flow of passage 124 in the blade 100. It is contemplated that the integrally molded one piece refractory metal core 142 may have many different configurations and constructions corresponding to the many different known configurations and constructions of cooling fluid flow passages.

The main portion 146 (FIG. 12) of the integrally molded one piece refractory metal core 142 forms the portion of the cooling fluid flow of passage 124 disposed in the airfoil portion 102 of the blade 100. The main portion 146 of the integrally molded one piece refractory core 142 includes a leading edge portion 150 and a trailing edge portion 152. A concave major side surface 154 (FIG. 13) extends between the leading edge portion 150 and the trailing edge portion 152. Similarly, a convex major side surface 156 also extends between the leading edge portion 150 and trailing edge portion 152.

A channel 158 (FIG. 13) is formed in the main portion 146 of the integrally molded one piece refractory core 142. The channel 158 (FIG. 13) has a configuration corresponding to the configuration of the divider 136 (FIG. 11) which separates the fluid inlet portion 130 of the cooling fluid flow of passage 124 from the fluid outlet portion 132 of the cooling fluid flow of passage. The channel 158 does not extend throughout the entire length of the integrally molded one piece refractory metal core and is not effective to divide the core into two pieces.

The core 142 includes a tip end portion 162 (FIG. 12) which is disposed opposite of the base portion 148 of the core. The tip end portion 162 of the core 142 may have one or more projections which form openings in the tip end portion 116 (FIG. 10) of the blade 100. The tip end portion 162 (FIG. 12) of the integrally molded one piece refractory metal core 142 at least partially forms the portion of the cooling fluid flow passage 124 (FIG. 1) where the fluid inlet portion 124 is connected with the fluid outlet portion 132.

Figure 8:
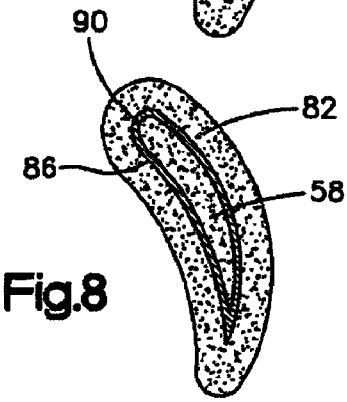
FIG. 8 is a schematic illustration depicting the manner in which the article mold cavity of FIG. 7 is filled with molten metal.

When molten metal is being conducted into a mold cavity during casting of the blade 100 (FIG. 10), in a manner similar to that previously described in conjunction with FIG. 8, the leading edge portion 150 (FIG. 12) of the integrally molded one piece refractory metal core 142 is disposed adjacent to the leading edge portion 104 of the blade 100 (FIG. 10). Similarly, the trailing edge portion 152 (FIG. 12) of the integrally molded one piece refractory core 142 is disposed adjacent to the trailing edge portion 106 (FIG. 10) of the blade 100. At this time, the base portion 148 (FIG. 12) of the integrally molded one piece refractory core 142 is enclosed by metal forming the base or root portion 118 (FIG. 10) of the blade 100.

The thickness of the integrally molded one piece refractory core 142 (FIGS. 12 and 13) varies. The thickness of the integrally molded one piece of refractory metal core 142 is the distance between the concave and convex major side surfaces 154 and 156. This distance is measured along an axis which is normal to at least one of the major side surfaces 154 and 156.

The trailing edge portion 152 of the main portion 146 (FIG. 13) of the one piece refractory metal core 142 is relatively thin while a central or connector portion 166 of the integrally molded one piece refractory core 142 is relatively thick. In a portion of the trailing edge portion 152 of the integrally molded one piece refractory metal core 142, the concave and convex major side surfaces 154 and 156 are separated by a distance of twelve thousandths of an inch (0.012 of an inch) or less as measured along an axis which extends perpendicular to the concave major side surface 154 at the trailing edge portion 152, that is, along an axis which is normal to the concave major side surface 154 of the integrally molded one piece refractory core 142. Of course, the distance which the concave and convex major side surfaces 154 and 156 are separated at the trailing edge portion 152 of the integrally molded one piece refractory core 142 will vary depending upon the design of the cooling fluid flow of passage 124 to be formed within the airfoil portion 102 of the blade 100.

Figure 14:
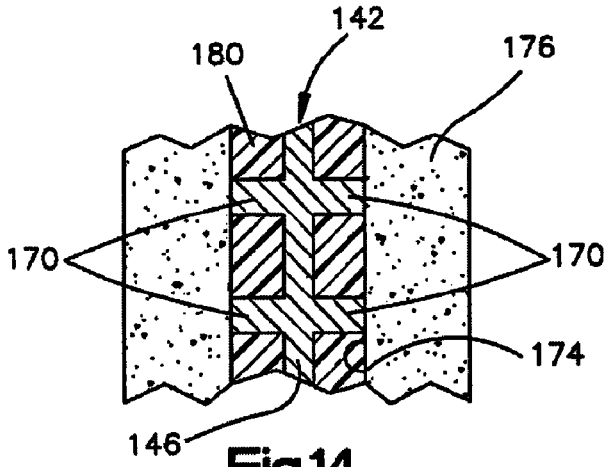
FIG. 14 is a fragmentary schematic illustration depicting a one piece refractory metal core formed in the manner illustrated schematically in FIGS. 1-4 and having projections which are utilized to form openings in opposite sides of a blade, similar to the blade of FIGS. 10 and 11.

The blade 100 (FIGS. 10 and 11) has concave and convex major side surfaces 110 and 112 which are free of openings. However, if desired, the integrally molded one piece refractory core 142 may be designed with projections 170 (FIG. 14). The projections 170 are utilized to define openings in the metal of the blade 100 as the metal solidifies in an article mold cavity 174 defined by a covering 176 of mold material. The covering 176 of mold material may be similar to the covering 82 of FIG. 6.

The projections 170 extend through wax 180 which encloses the integrally molded one piece refractory metal core 142. Outer ends of the projection 170 (FIG. 14) are disposed in engagement with inner side surfaces of the article mold cavity 174. If desired, side surface areas on outer end portions of the projections may be engaged by surfaces of recesses in the mold material 176. When the wax 180 is melted and removed from the covering 176 of mold material, each of the projections 170 extends from the main portion 146 of the core across a portion of the article mold cavity 174.

The integrally molded one piece refractory metal core 142 of FIG. 14 has a pair of aligned projections 170 extending from opposite sides of the core into engagement with opposite side surfaces of the article mold cavity 174. This results in aligned openings being formed in the concave and convex major side surfaces 110 and 112 (FIG. 11) of the airfoil portion 102 of the blade 110. If desired, a projection 170 (FIG. 14) may extend from one side of the core 142 without having a corresponding projection extending from the opposite side of the core. If all of the projections 170 were to extend from only one side of the core 142, all of the openings would be formed in one side of the blade 100 (FIGS. 10 and 11). For example, the projections 170 (FIG. 14) at one location on the core 142 may extend into engagement with one side surface of the article mold cavity 174 and form openings in only the concave major side surface 110 (FIG. 11) of the blade 100. If desired, additional projections 170 (FIG. 14) at another location on the core 142 may extend into engagement with another side surface of the article mold cavity 184 and form openings in the convex major side surface 112 (FIG. 11) of the blade 100.

When molten metal is poured into the mold cavity 174 after the wax 180 (FIG. 14) has been removed, the molten metal solidifies around the projections 170. When the cast metal blade is subsequently removed from the article mold cavity 174 and the integrally molded one piece refractory metal core 142 is removed from the cast metal blade, openings are formed in the surfaces of the blade where the projections 170 were previously disposed. This may result in the blade having openings in concave and convex major side surfaces 110 and 112 of the blade.

The projections 170 may have any desired configuration. However, the illustrated projections 170 have cylindrical configurations and result in the formation of circular openings in the concave and convex major side surfaces 110 and 112 of the blade 100. The projections 170 may be disposed adjacent to the trailing edge portion 152 of the integrally molded one piece refractory core 142. Alternatively, the projections may be disposed adjacent to the central portion 166 and/or the leading edge portion 150 of the refractory metal core. As was previously discussed, it is contemplated that the projections 170 may be offset from each other or that the projections may extend in only one direction from the integrally molded one piece refractory metal core 142.

Although the projections 170 have a cylindrical configuration and form circular openings in the blade 110, the projections may have a different configuration. For example, the projections 170 may be configured so as to form one or more slots in one of the side surfaces 110 or 112 of the blade 100. It is contemplated that the trailing edge portion 152 of the integrally molded one piece refractory core 142 may be extended so as to form one or more slots in the blade 100 either adjacent to or at the trailing edge portion 106 of the blade.

In addition to the forming of one or more openings in the surface or surfaces of the blade 100, it is contemplated that it may be desired to provide support posts or pedestals which extend between opposite sides of the blade and are integrally cast as one piece with the blade. The formation of the support posts or pedestals is facilitated by forming the integrally molded one piece refractory metal core 142 (FIG. 15) with a plurality of holes or openings 186 in which molten metals solidifies. The resulting support posts or pedestals span the space between opposite sides of the blade 100 in much the same manner as in which the divider 136 (FIG. 11) spans the space between the opposite sides of the blade.

The support posts or pedestals may be disposed at locations adjacent to or at the trailing edge portion 106 (FIG. 10) of the blade 100. This would enable the cooling fluid flow of passage 124 to extend into or at least closely adjacent to, the trailing edge portion 106 of the blade 100. Of course, the support posts or pedestals may be disposed at other locations in the blade 100.

Figure 15:
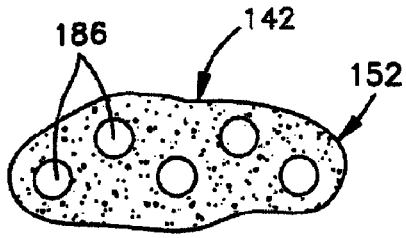
FIG. 15 is a fragmentary schematic illustration of a portion of a one piece refractory metal core formed in the manner illustrated schematically in FIGS. 1-4 and having openings to enable supports to extend between opposite sides of the blade of FIGS. 10 and 11.

The openings 186 have been illustrated in FIG. 15 as being formed in the trailing edge portion 152 of the integrally molded one piece refractory metal core 142. The trailing edge portion 152 of the integrally molded one piece refractory metal core 142 has a thickness of twelve thousandth of an inch (0.012 of an inch) or less. The circular openings 186 (FIG. 15) may have a diameter which is one-fourth (¼) or less of the thickness of the portion of the refractory metal core 142 in which the openings are formed. Thus, the holes 186 may have a diameter of three thousandths of an inch (0.003 of an inch) or less when the holes are formed in a portion of the core having a thickness of twelve thousandths of an inch (0.012 of an inch) or less. Of course, the openings 186 may have a larger diameter if desired.

It is contemplated that the openings 186 may be relatively close together. Thus, the openings 186 may be separated by a distance which is equal to or less than the diameter of the holes 186. In the foregoing example in which the holes 186 have a diameter of three thousandths of an inch (0.003 of an inch) or less, the holes would be separated by a distance of three thousandths of an inch (0.003 of an inch) or less. Of course, the openings 186 may be spaced further apart if desired.

It should be understood that the foregoing dimensions for the openings 186 are for one specific core 142. Other cores may be designed with openings or holes 186 having different dimensions and/or configurations. When posts or pedestals with an elongated configuration are to be formed in the blade 100, the openings 186 may be formed as slots. It should also be understood that the core 142 may have a combination of projections 170 (FIG. 14) and openings 186 (FIG. 15).

It is contemplated that the blade 10 and the integrally molded one piece refractory metal core 142 may have many configurations other than the specific configurations illustrated in FIGS. 10-15. For example, the blade 100 and/or core 142 may have any one of the configurations disclosed in U.S. Pat. No. 7,014,424 if desired. The disclosure in the aforementioned U.S. Pat. No. 7,014,424 is hereby incorporated herein in its entirety by this reference thereto. It should be understood that the blade 100 and/or integrally molded one piece refractory metal core 142 may have a construction which is similar to the construction of any one of many known blades and/or cores.

Although the blade 100 and associated core 142 have been illustrated in FIGS. 10-15, an integrally molded one piece refractory metal core may advantageously be utilized during formation of a vane. Cooling passages having any one of many known configurations may be formed in a vane in much of the same manner as previously described in conjunction with the blade 100. It is contemplated that the vane may have a construction which is similar to any one of the constructions disclosed in U.S. Pat. Nos. 4,025,226; 5,405,242; and/or 5,645,397. The disclosures in the aforementioned U.S. Patents are hereby incorporated herein in their entirely by this reference thereto.

Setter Block

In order to control the manner in which a one piece molded refractory metal article 192 (FIG. 16) shrinks during sintering, a one piece setter block 196 may be utilized. The setter block 196 is molded in the same way and of the same refractory metal as the one piece molded refractory metal article 192. The one piece molded refractory metal article 192 has the same construction and is formed in the same way as the one piece molded refractory metal article 34 of FIGS. 1 and 2.

The green or unfired refractory metal setter block 196 is sintered at the same time as the one piece molded refractory metal article 192. Since the one piece molded refractory metal article 192 and the one piece molded refractory metal setter block 196 are formed in the same way and of the same material, they tend to shrink to the same extent when they are sintered. Thus, there is between twenty percent (20%) and sixty percent (60%) shrinkage of both the one piece molded refractory metal article 192 and the one piece molded refractory metal setter block 196 when they are sintered at a temperature above 2,200 degrees Fahrenheit. This enables the setter block 196 to be configured in such a manner as to support and to some extent restrain the one piece molded refractory metal article 192 during sintering of the article to form an integrally molded one piece refractory metal core similar to the cores 58 and 142 of FIGS. 3 and 12.

The setter block 196 includes a cradle section 200 which receives the one piece molded refractory metal article 192. The cradle section 200 is supported by base sections 202 and 204. The cradle section 200 has an upper side surface 208 with a configuration which corresponds to the configuration of a side surface of the one piece molded refractory metal article 192 which is to engage the upper side surface 208 of the setter block 196. Thus, the upper side surface 208 of the setter block 196 has a configuration corresponding to the configuration of the downwardly facing convex side surface 212 of the one piece molded refractory metal article 192. Of course, if the one piece molded refractory metal article 192 was placed on the setter block 196 with the concave side surface 214 of the one piece molded refractory metal article 192 facing downward, the upper side surface 208 of the cradle section of the setter block 196 would have a configuration corresponding to the configuration of the concave side surface 214 of the one piece molded refractory metal article.

The cradle section 200 has a uniform thickness throughout its length, that is, throughout the distance between the base section 202 and the base section 204. The lower side surface 218 of the cradle section 200 has a configuration which is similar to the configuration of the upper side surface 208 of the cradle section. Therefore, an axis which is normal to the lower side surface 218 of the cradle section 200 is also normal to the upper side surface 208 of the cradle section. The distance between the lower side surface 218 and the upper side surface 208, as measured along an axis which is normal to the lower side surface 218, is the same at any location on the lower side surface.

The setter block 196 may be formed using an injection molding apparatus having the same general construction and method of operation as the injection molding apparatus 38 of FIG. 1. Refractory metal particles, corresponding to the refractory metal particles 28 of FIG. 1, are forced into an article mold cavity having a configuration corresponding to the desired configuration of the setter block 196. Although any desired refractory metal particles 28 may be utilized, the refractory metal particles are molybdenum. The refractory metal particles are forced into a setter block mold cavity with sufficient force to have the particles adhere to each other and make an integrally molded one piece refractory metal article having a configuration corresponding to the configuration of the setter block 196.

The one piece molded refractory metal article having a configuration corresponding to the configuration of the setter block 196 is moved from the die to a solvent debinding apparatus. This solvent debinding apparatus has the same construction as the solvent debinding apparatus 50 of FIG. 2. While the one piece molded refractory metal article, corresponding to the setter block 196, is in the solvent debinding apparatus, the binder is removed from the one piece molded refractory metal article.

Once the one piece molded refractory metal article having a configuration corresponding to the configuration of the setter block 196 has been debound, it is moved into the sintering furnace 54 (FIG. 3). The one piece molded refractory metal article 192 (FIG. 16) is placed on the cradle section 200 of the one piece molded refractory metal article corresponding to the setter block 196 either before or immediately after they are placed in the sintering furnace. Both the one piece molded refractory metal article 192 and the one piece molded refractory metal article corresponding to the setter block 196 are sintered, at a temperature of at least 2,200° F., in the sintering furnace.

Since the one piece molded refractory metal article 192 and the one piece molded refractory metal article corresponding to the setter block 196 are formed in the same way and from the same materials, they shrink to the same extent during sintering. The one piece molded refractory metal article 192 and the setter block 196 both shrink between twenty percent (20%) and sixty percent (60%) during sintering. This enables the setter block 196 to minimize deformation of the refractory metal article 192 during sintering. Although it is believed that it will be desired to use the setter block 196 to support some molded refractory metal articles during sintering, other molded refractory metal articles may be sintered without using a setter block.

Blade Outer Air Seal

It is contemplated that the method and apparatus of the present invention will be utilized during the formation of many different articles. One of these articles may be a blade outer air seal 230 (FIG. 17) which forms a portion of a shroud in a turbine engine. The blade outer air seal is formed as a segment of a circle. This enables a plurality of a blade outer air seals 230 to be disposed in an annular ring which extends around circular array of rotor blades in a turbine engine to confine working fluid to a desired a fluid flow path.

Figure 17:
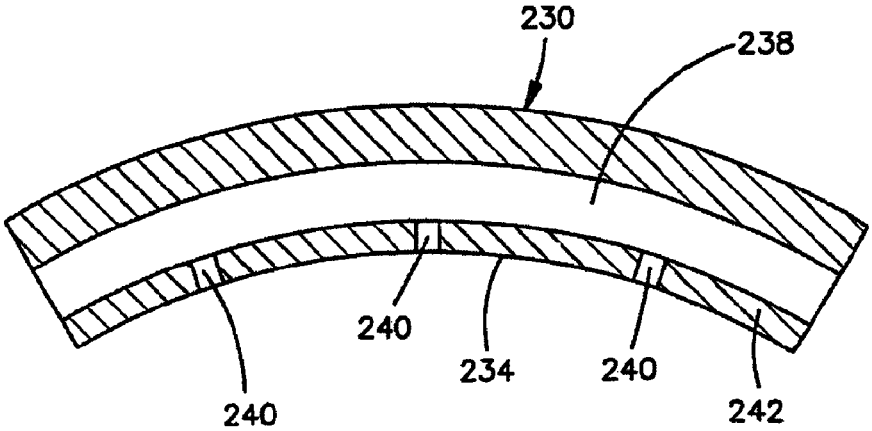
FIG. 17 is a schematic illustration of a blade outer air seal which is cast with a refractory metal core formed and utilized in the manner illustrated schematically in FIGS. 1-9.

The blade outer air seal 230 has a circular inner side surface 234 which is formed as a portion of a cylinder. The inner side surface 234 has an extent, in an axial direction, which is at least as great as the axial extent of an array of blades with which the blade outer air seal 230 is to cooperate. The inner side surface 234 cooperates with the array of blades to restrict fluid flow across the tips of the blades. Although only a single blade outer air seal 230 is illustrated in FIG. 17, it should be understood that there are a plurality of blade outer air seals 230 disposed in a circular array within a turbine engine to form a cylinder within which the array of blades rotates.

The blade outer air seal 230 has a cooling fluid flow of passage 238. The cooling fluid flow of passage 238 may have a serpentine configuration, in the manner disclosed in U.S. Pat. No. 5,486,090. Alternatively, the cooling fluid flow of passage may have an arcuate configuration as disclosed in U.S. Pat. No. 5,374,161. The disclosures in the aforementioned U.S. Pat. Nos. 5,486,090 and 5,374,161 are hereby incorporated herein in their entirety by this reference thereto.

A plurality of transverse cooling fluid flow of passage or holes 240 are formed in the radially inner side wall 242 of the blade outer air seal 230. The holes 240 enable cooling fluid to flow from the passage 238 radially inward toward the blades to cool the radially inner wall 242 of the blade outer seal 230. This provides a flow of cooling fluid towards the tips of the blades.

The blade outer air seal 230 is cast with a refractory metal core formed and utilized in the same manner as is illustrated schematically in FIGS. 1-8. Thus, a one piece molded refractory metal article having the same configuration as the cooling fluid flow of passage 238 is formed in a die corresponding to the die 32 of FIG. 1. The one piece molded refractory metal article is removed from the die and debound using a solvent debinding apparatus, similar to the solvent debinding apparatus 50 of FIG. 2.

The one piece molded refractory metal article having a configuration corresponding to the configuration of the cooling fluid flow of passage 238 is provided with projections which correspond to the holes or openings 240 to be formed in the inner side wall 242 of the blade outer air seal 230. The openings 240 are formed in the side wall 242 by the projections in the same manner as previously described herein in conjunction with the projections 170 of FIG. 14.

The integrally molded one piece refractory metal (molybdenum) article having a configuration corresponding to the configuration of the cooling fluid flow of passage 238 is then positioned on a setter block. The setter block is a one piece molded refractory metal article formed by shaping a body of refractory metal particles (molybdenum) in a die in the same manner as is illustrated schematically in FIG. 1. The setter block is formed in the same manner as previously described herein in conjunction with the setter block 196 of FIG. 16.

Figure 16:
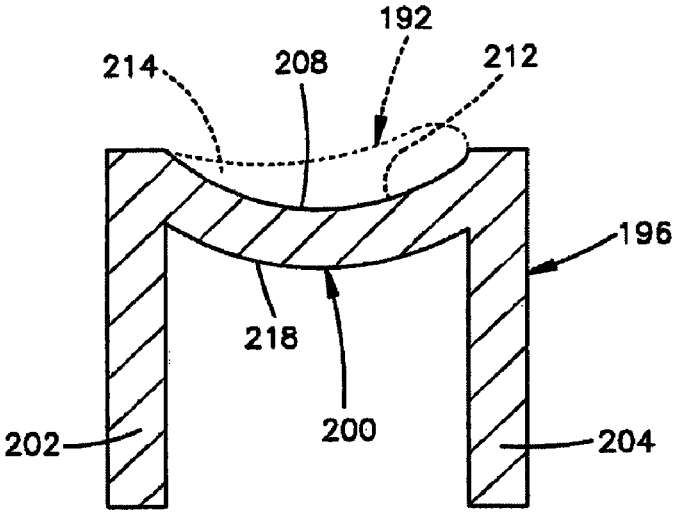
FIG. 16 is a schematic illustration depicting the manner in which a refractory metal core formed in the manner illustrated schematically in FIGS. 1-3, is positioned on a molded refractory metal setter block prior to being sintered.

The one piece refractory metal article having a configuration corresponding to the fluid flow passage and the one piece refractory metal article having a configuration corresponding to the configuration of the setter block are simultaneously sintered to form an integrally molded one piece refractory metal (molybdenum) core in the manner previously described in conjunction with FIGS. 3 and 16. The setter block and the one piece refractory metal article are formed in the same way from the same material. They are sintered at the same time.

The setter block has a cradle section, corresponding to the cradle section 200 of the setter block 196 of FIG. 16. The cradle section 200 is shaped to receive the integrally molded one piece refractory metal article having a configuration corresponding to the configuration of the cooling fluid passage 238 (FIG. 17). The saddle section of the setter block has a convex upper side which engages a concave, radially inner, side of the one piece refractory metal article having a configuration corresponding to the configuration of the cooling fluid passage 238. Of course, the saddle section of the setter block could have a different configuration and engage a different side of the integrally molded one piece refractory metal article having a configuration corresponding to the configuration of the cooling fluid passage 238.

Figure 4:
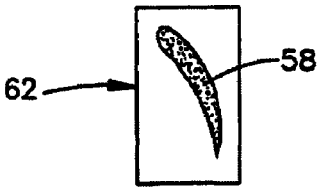
FIG. 4 is a schematic illustration depicting the manner in which a protective coating is applied to the refractory metal core of FIG. 3.

The integrally molded one piece refractory core is then coated using a chemical vapor deposition apparatus, corresponding to the apparatus 62 of FIG. 4.

Figure 7:
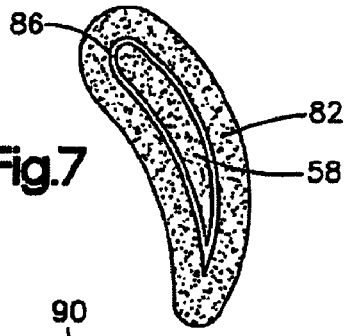
FIG. 7 is a schematic illustration depicting the mold material and refractory metal core of FIG. 6 after the wax has been removed to form an article mold cavity.

Once the integrally molded one piece refractory metal core having a configuration corresponding to the configuration of the cooling fluid flow of passage 238 and transverse passage and openings 240 has been formed, the core is coated with wax utilizing a wax injection mold, corresponding to the wax injection mold 66 of FIG. 5. The wax coated core is then covered with mold material in the manner illustrated schematically in FIG. 6 for the core 58. An article mold cavity, corresponding to the article mold cavity 86 of FIG. 7, is then formed with a configuration corresponding to the desired configuration of the blade outer air seal 230 of FIG. 17. Molten metal is then poured into the mold cavity and the core is subsequently removed to form the blade outer seal 230 in the manner previously described herein.

CONCLUSION

In view of the foregoing description, it is apparent that the present invention provides a new and improved method of making cast metal articles 20, 100, and 230 utilizing new and improved refractory metal cores 58 and 142. In practicing the method, a body of refractory metal particles 28 is shaped to form a one piece molded refractory metal article 34 or 192 having a configuration which is a function of a desired configuration of a space 22, 124, or 238 in the cast metal article. The molded refractory metal article 34 is sintered to form a refractory metal core 58 or 142 which is integrally formed as one piece.

When the molded refractory metal article 34 or 192 is to be sintered, the molded refractory article may advantageously be positioned on a setter block 196 which is formed by shaping a body of refractory metal particles. While the refractory metal article 34 or 192 is disposed on the refractory metal setter block 196, both the setter block and the molded refractory metal article are sintered to form a refractory metal core which is disposed on the sintered setter block.

The integrally formed one piece refractory metal core 58 or 142 is positioned in a mold cavity 86 having a configuration corresponding to the desired configuration of the metal article to be cast. Molten metal is poured into the article mold cavity and solidified to form the cast metal article 20, 100 or 230. The refractory metal core is removed from the cast metal article.

It is contemplated that the refractory metal core 58 or 142 may be utilized to form space in many different types of cast metal articles. These cast metal articles may include turbine engine components. The turbine engine components may be blades or vanes. Alternatively, the turbine engine components may be part of a casing. For example, the turbine engine components may be a blade outer air seal 230. Of course, the refractory metal core may be utilized to cast articles other than components of turbine engines.

In the foregoing description, molybdenum particles 28 have been utilized. However, it should be understood that other refractory metal particles may be utilized if desired. It is also contemplated that the refractory metal particles 28 may be mixtures or alloys and intermetallics of refractory metal particles.

Having described the invention, the following is claimed:

1. A method of making a cast metal article in which a space is disposed, said method comprising the steps of shaping a body of refractory metal particles in a first mold cavity to form a one piece molded refractory metal article having a configuration which is a function of the desired configuration of the space in the cast metal article, removing the one piece molded refractory metal article from the first mold cavity, sintering the one piece molded one piece refractory metal article to form a one piece refractory metal core, positioning the one piece refractory metal core in a second mold cavity having a configuration which is a function of the desired configuration of the metal article to be cast, shaping wax in the second mold cavity with at least a portion of the wax in engagement with at least a portion of the one piece refractory metal core, removing the one piece refractory metal core from the second mold cavity with wax disposed around at least a portion of the one piece refractory metal core, enclosing at least a portion of the wax and at least a portion of the one piece refractory metal core with a covering of mold material, removing the wax from the covering of mold material to form an article mold cavity, filling the article mold cavity with molten metal, solidifying the molten metal in the article mold cavity to form a cast metal article, removing the covering of mold material from around the cast metal article which at least partially encloses the one piece refractory metal core, and removing the one piece refractory metal core from the cast metal article to form the cast metal article in which the space is disposed.

2. A method as set forth in claim 1 wherein the cast metal article in which the space is disposed is a blade for use in a turbine engine, said blade having an airfoil with a leading edge portion, a trailing edge portion, and a curved connector portion extending between the leading and trailing edge portions, said step of shaping a body of refractory metal particles in a first mold cavity to form a one piece molded refractory metal article includes forming a one piece molded refractory metal article having a leading edge portion, a trailing edge portion, and a curved connector portion which extends between said leading and trailing edge portions, said one piece molded refractory metal article having a configuration which is a function of the configuration of portions of passages to be formed in the leading edge portion, trailing edge portion, and connector portion of the airfoil, said step of removing the refractory metal core from the cast metal article includes forming fluid flow passages which extend into the leading edge portion, trailing edge portion, and connector portion of the airfoil.

3. A method as set forth in claim 1 wherein the cast metal article in which the space is disposed is a vane for use in a turbine engine, said vane including an airfoil with a leading edge portion, a trailing edge portion, and a curved connector portion extending between the leading and trailing edge portions, said step of shaping a body of refractory metal particles in a first mold cavity to form a one piece molded refractory metal article includes forming a one piece molded refractory metal article having a leading edge portion, a trailing edge portion, and a curved connector portion which extends between said leading and trailing edge portions, said one piece molded refractory metal article having a configuration which is a function of the configuration of portions of passages to be formed in the leading edge portion, trailing edge portion and connector portion of the airfoil, said step of removing the refractory metal core from the cast meal article includes forming fluid flow passages which extend into the leading edge portion, trailing edge portion and connector portion of the airfoil.

4. A method as set forth in claim 1 wherein the cast metal article is at least a portion of a shroud for at least partially enclosing blades in a turbine engine, said step of shaping a body of refractory metal particles in a first mold cavity to form a one piece molded refractory metal article includes forming a one piece molded refractory metal article having a configuration which is a function of at least a portion of a passage to be formed in the shroud, said step of removing the refractory metal core from the cast metal article includes forming at least a portion of a passage in at least a portion of the shroud.

5. A method as set forth in claim 1 wherein said step of sintering the one piece molded refractory metal article includes positioning the one piece molded refractory metal article on a molded refractory metal setter block and sintering both the molded refractory metal article and the setter block.

6. A method as set forth in claim 1 wherein said step of shaping a body of refractory metal particles in a first mold cavity includes injecting particles of molybdenum into the first mold cavity and forming a one piece molded article of molybdenum particles.

7. A method as set forth in clam 1 further including the step of applying a protective coating over the one piece refractory metal core to prevent oxidation of the one piece refractory metal core.

8. A method as set forth in claim 7 wherein said step of applying a protective coating over the one piece refractory metal core is performed after performing said step of sintering the molded refractory metal article.

9. A method as set forth in claim 1 wherein said step of sintering the one piece molded refractory metal article includes positioning the one piece molded refractory metal article on a one piece molded refractory metal setter block, heating both the one piece molded refractory metal article and the one piece molded refractory metal setter block to a temperature above 2,200° F., and shrinking both the one piece molded refractory metal article and the one piece molded refractory metal setter block by at least twenty percent (20%) during heating of the one piece molded refractory metal article and the one piece molded refractory metal setter block.

10. A method as set forth in claim 1 further including the steps of shaping a second body of refractory metal particles in a third mold cavity to form a second one piece molded refractory metal article having a configuration which is a function of the desired configuration of a setter block, said step of sintering the one piece molded refractory metal article includes positioning the one piece molded refractory metal article on the second one piece molded refractory metal article, heating both the one piece molded refractory metal article and the second one piece molded refractory article to a temperature which is above 2,200° F., and decreasing the size of both the one piece molded refractory metal article and the second one piece molded refractory metal article by at least twenty percent (20%) while the one piece refractory metal article is disposed on the second one piece refractory metal article.

11. A method as set forth in claim 10 wherein said step of forming a second one piece molded refractory metal article includes forming a second one piece molded refractory metal article having a first arcuately curving surface area which faces in a first direction and a second arcuately curving surface area which faces in a second direction opposite to the first direction and has a configuration which is similar to the configuration of the first arcuately curving surface area, said step of positioning the one piece molded refractory metal article on the second one piece molded refractory metal article includes engaging the first arcuately curving surface area on the second one piece molded refractory metal article with an arcuately curving surface area on the one piece molded refractory metal article.

12. A method as set forth in claim 1 wherein said step of shaping a body of refractory metal particles in a first mold cavity includes injecting refractory metal particles into the first mold cavity to form a body of refractory metal particles having a configuration corresponding to the configuration of the first mold cavity.

13. A method as set forth in claim 1 wherein the cast metal article includes an airfoil portion with a concave inner side and a convex outer side, said step of shaping a body of refractory metal particles in a first mold cavity to form a one piece molded refractory metal article includes forming a one piece molded refractory metal article having a concave inner side and a convex outer side with a plurality of projections extending from the concave inner side of the one piece molded refractory metal article, said step of sintering the one piece molded refractory metal article to form a one piece refractory metal core includes forming the one piece refractory metal core with a concave inner side and convex outer side with a plurality of projections extending from the concave inner side of the one piece refractory metal core, said step of shaping wax around the one piece refractory metal core includes positioning wax around each projection of the plurality of projections at a location adjacent to the concave inner side of the one piece refractory metal core, said step of removing the one piece refractory metal core from the cast metal article includes removing the plurality of projections extending from the concave inner side of the one piece refractory metal core from the cast metal article to form a plurality of openings in the concave inner side of the cast metal article.

14. A method as set forth in claim 13 wherein the concave inner side and convex outer side of the airfoil portion of the cast metal article extend between leading and trailing edge portions of the airfoil portion of the cast metal article, said step of removing the plurality of projections extending from the concave inner side of the one piece refractory metal core from the cast metal article to form a plurality of openings in the concave inner side of the cast metal article includes forming the plurality of openings at a location adjacent to the trailing edge portion of the cast metal article.

15. A method as set forth in claim 13 wherein the concave inner side and convex outer side of the airfoil portion of the cast metal article extend between leading and trailing edge portions of the airfoil portion of the cast metal article, said step of removing the plurality of projections extending from the concave inner side of the one piece refractory metal core from the cast metal article to form a plurality of opening in the concave inner side of the cast metal article includes forming the plurality of openings at a location adjacent to the leading edge portion of the cast metal article.

16. A method as set forth in claim 13 wherein the concave inner side and convex outer side of the airfoil portion of the cast metal article extend between leading and trailing edge portions of the airfoil portion of the cast metal article, said step of removing the plurality of projections extending from the concave inner side of the one piece refractory metal core from the cast metal article to form a plurality of openings in the concave inner side of the cast metal article includes forming the plurality of openings at a location between the leading edge portion and the trailing edge portion of the cast metal article.

17. A method as set forth in claim 1 wherein the cast metal article has a concave inner side and a convex outer side, said step of shaping a body of refractory metal particles in a first mold cavity to form a one piece molded refractory metal article includes forming a one piece molded refractory metal article having a concave inner side and a convex outer side, said step of sintering the one piece molded refractory metal article to form a one piece refractory metal core includes forming the one piece refractory metal core with at least a portion of the concave inner side and convex outer side separated by a distance of twelve thousandths of an inch (0.012 of an inch) or less as measured along an axis which is normal to the convex outer side of the one piece refractory metal core.

18. A method as set forth in claim 17 wherein the cast metal article includes an airfoil portion on which the concave inner side and convex outer side are disposed, said step of removing the one piece refractory metal core from the cast metal article includes removing a portion of the one piece refractory metal core having the concave inner side and convex outer side separated by a distance of twelve thousandths of an inch (0.012 of an inch) or less from a portion of the cast metal article which is located adjacent to a trailing edge portion of the airfoil portion of the cast metal article.

19. A method as set forth in claim 1 the cast metal article is at least a portion of a shroud for at least partially enclosing blades in a turbine engine, said step of removing the one piece refractory metal core from the cast metal article includes forming at least a portion of a passage in at least a portion of the shroud.

20. A method as set forth in claim 1 further including the steps of mixing a binder with the refractory metal particles prior to shaping the body of refractory metal particles in a first mold cavity, and removing at least a portion of the binder from the one piece molded refractory metal article before sintering the one piece molded refractory metal article.

21. A method as set forth in claim 1 wherein said step of shaping a body of refractory metal particles to form a one piece molded refractory metal article includes forming a plurality of holes which extend through the one piece molded refractory metal article, said step of sintering the one piece molded refractory metal article to form a one piece refractory metal core includes forming the core with circular holes having a diameter which is one fourth (¼) or less of the thickness of a portion of the one piece refractory metal core in which the holes are formed.

22. A method as set forth in claim 1 wherein said step of sintering the molded refractory metal to form a refractory metal core includes forming the refractory metal core with at least a portion of the refractory metal core having opposite sides separated by a distance of twelve thousandths of an inch (0.012 of an inch) or less as measured along an axis which is perpendicular to at least a portion of at least one of the sides of the refractory metal core.

23. A method as set forth in claim 22 wherein said step of forming the one piece refractory metal core with at least a portion of the one piece refractory metal core having opposite sides separated by a distance of twelve thousandths of an inch (0.012 of an inch) or less includes forming at least one circular hole having diameter of three thousandths of an inch (0.003 of an inch) or less in said portion of the one piece refractory metal core.

24. A method as set forth in claim 22 wherein said step of forming the one piece refractory metal core with at least a portion of the refractory metal core having opposite sides separated by twelve thousandths of an inch (0.012 of an inch) or less includes forming a plurality of circular holes having a diameter of three thousandths of an inch (0.003 of an inch) or less and separated by a distance which is equal to or less than the diameter of the holes.

25. A method as set forth in claim 1 wherein said step of shaping a body of refractory metal particles includes shaping a body of refractory metal powder having an average particle size of ten (10) to twenty (20) microns with the smallest particles having a particle size of less than one (1) micron.

26. A method of making a cast metal article in which a space is disposed, said method comprising the steps of injecting particles of a refractory metal into a first mold cavity to form a first molded refractory metal article having a configuration which is a function of the desired configuration of a setter block, injecting particles of a refractory metal into a second mold cavity to form a second molded refractory metal article having a configuration which is a function of the desired configuration of the space in the cast metal article, removing the first molded refractory metal article from the first mold cavity, removing the second molded refractory metal article from the second mold cavity, positioning the second molded refractory metal article on the first molded refractory metal article, sintering the first and second molded refractory metal articles with the second molded refractory metal article disposed on the first molded refractory metal article to form a refractory metal core which is smaller than the second molded refractory metal article, positioning the refractory metal core in an article mold cavity having a configuration which is a function of the desired configuration of the metal article to be cast, filling the article mold cavity with molten metal, solidifying the molten metal in the article mold cavity to form a cast metal article, and removing the refractory metal core from the cast metal article.

27. A method as set forth in claim 26 further including the steps of forming an article mold by shaping wax around the refractory metal core and enclosing at least a portion of the wax and at least a portion of the refractory metal core with a covering of mold material, and removing the wax from the covering of mold material to form the article mold cavity.

28. A method as set forth in claim 26 wherein said step of sintering the first and second molded refractory metal articles includes reducing the first and second molded refractory metal articles in size by at least twenty percent (20%).

29. A method as set forth in claim 26 wherein said step of sintering the first and second molded refractory metal articles to form a refractory metal core includes forming at least a portion of the refractory metal core with a thickness of twelve thousandths of an inch (0.012 of an inch) or less.

30. A method of making a blade outer air seal for use in a turbine engine, said method comprising the steps of shaping a body of refractory metal particles in a first mold cavity to form a molded refractory metal article having a configuration which is a function of a desired configuration of a cooling fluid flow passage in the blade outer air seal, sintering the molded refractory metal article to form a refractory metal core, positioning the refractory metal core in a second mold cavity having an arcuate side wall and a second side wall which faces toward and is spaced from the arcuate side wall, said step of positioning the refractory metal core in the second mold cavity includes positioning at least a portion of the refractory metal core between the arcuate side wall and the second side wall of the second mold cavity, shaping wax in the second mold cavity with at least a portion of the wax in engagement with at least a portion of the refractory metal core and with at lest a portion of the wax in engagement with the arcuate side wall of the second mold cavity and with at least a portion of the wax in engagement with the second side wall of the second mold cavity, enclosing at least a portion of the wax and at least a portion of the refractory metal core with a covering of mold material, removing the wax from the covering of mold material to form an article mold cavity having a configuration corresponding to the configuration of the blade outer air seal, filling the article mold cavity with molten metal which encloses at least a portion of the refractory metal core, solidifying the molten metal in the article mold cavity to form a blade outer air seal which at least partially encloses the refractory metal core, removing the covering of mold material from around the blade outer air seal, and removing the refractory metal core from the blade outer air seal.

31. A method as set forth in claim 30 wherein said sep of sintering the molded refractory metal article includes positioning the molded refractory metal article on a molded refractory metal setter block and heating both the molded refractory metal article and the setter block.

32. A method as set forth in claim 30 wherein said step of shaping a body or refractory metal particles in a first mold cavity includes injecting particles of molybdenum into the first mold cavity and forming a one piece integrally molded article of molybdenum particles.

33. A method as set forth in claim 30 further including the step of applying a protective coating over the refractory metal core to prevent oxidation of the refractory metal core.

34. A method as set forth in claim 33 wherein said step of applying a protective coating over the refractory metal core is performed after performing said step of sintering the molded refractory metal article.

35. A method as set forth in claim 30 wherein said step of sintering the molded refractory metal article includes positioning the molded refractory metal article on a molded refractory metal sitter block, heating both the molded refractory metal article and the setter block to a temperature above 2,200° F., and shrinking both the molded refractory metal article and the setter block by at least twenty percent (20%) during heating of the refractory metal article and the setter block.

36. A method as set forth in claim 30 further including the steps of shaping a second body of refractory metal particles in a third mold cavity to form a second molded refractory metal article having a configuration which is a function of the desired configuration of a setter block, said step of sintering the molded refractory metal article includes positioning the molded refractory metal article on the second molded refractory metal article, heating both the molded refractory metal article and the second molded refractory article to a temperature which is above 2,200° F., and decreasing the size of both the molded refractory metal article and the second molded refractory metal article by at least twenty percent (20%) while the refractory metal article is disposed on the second refractory metal article.

37. A method as set forth in claim 36 wherein said step of forming a second molded refractory metal article includes forming a second molded refractory metal article having a first arcuately curving surface area which faces in a first direction and a second arcuately curving surface area which faces in a second direction opposite to the first direction and has a configuration which is similar to the configuration of the first arcuately curving surface area, said step of positioning the molded refractory metal article on the second molded refractory metal article includes engaging the first arcuately curving surface area on the second molded refractory metal article with an arcuately curving surface area on the molded refractory metal article.

38. A method as set forth in claim 30 wherein said step of shaping a body of refractory metal particles in a first mold cavity includes injecting refractory metal particles into the first mold cavity to form a body of refractory metal particles having a configuration corresponding to the configuration of the first mold cavity.

39. A method of making an airfoil for use in a turbine engine, said method comprising the steps of shaping a body of refractory metal particles in a first mold cavity to form a molded refractory metal article at least a portion of which has a configuration which is a function the desired configuration of at least one cooling passage in the airfoil, said refractory metal article being integrally molded as one piece and having a leading edge portion, a trailing edge portion, a convex major side which extends between said leading and trailing edge portions, and a concave major side which extends between said leading and trailing edge portions, removing the molded refractory metal article from the first mold cavity, sintering the molded refractory metal article to form a refractory metal core which is integrally formed as one piece and has a leading edge portion, a trailing edge portion, a convex major side which extends between said leading and trailing edge portions, and a concave major side which extends between said leading and trailing edge portions, positioning the one piece refractory metal core in a second mold cavity with the leading edge portion, trailing edge portion, convex major side, and concave major side of the one piece refractory metal core at least partially spaced from and enclosed by side surfaces of the second mold cavity, shaping wax in the second mold cavity with at lest a portion of the wax disposed in engagement with at least a portion of the one piece refractory metal core, removing the one piece refractory metal core from the second mold cavity with wax disposed around at least a portion of the refractory metal core, enclosing at least a portion of the wax and at least a portion of the one piece refractory metal core with a covering of mold material, removing the wax from the covering of mold material to form an article mold cavity, filling the article mold cavity with molten metal to form a cast metal airfoil, removing the covering of mold material from around the cast metal airfoil, and removing the one piece refractory metal core from the cast metal airfoil to form at least one cooling passage in the cast metal airfoil.

40. A method as set forth in claim 39 wherein said step of sintering the molded refractory metal article to form a one piece refractory metal core includes forming the one piece refractory metal core with a first thickness measured along a first axis which is normal to the concave major side of the one piece refractory metal core and extends through the trailing edge portion of the one piece refractory metal core and forming the one piece refractory metal core with a second thickness measured along a second axis which is normal to the concave major side of the one piece refractory metal core and extends through the one piece refractory metal core at a location offset from the first axis in a direction toward the leading edge portion of the one piece refractory metal core, the second thickness being greater than the first thickness.

41. A method as set forth in claim 39 wherein said step of shaping the body of refractory metal particles in a first mold cavity to form a molded refractory metal article includes forming the refractory metal article with a root portion which is integrally molded as one piece with said leading and trailing edge portions.

42. A method as set forth in claim 39 further including the step of applying a protective coating over the refractory metal core after performing said step of sintering the molded refractory metal article and prior to performing said step of positioning the one piece refractory metal core in a second mold cavity to prevent oxidation of the one piece refractory metal core during performance of said step of filling the article mold cavity with molten metal.

43. A method as set forth in claim 39 wherein said step of sintering the molded refractory metal article includes positioning the molded refractory metal article on a molded refractory metal sitter block, heating both the molded refractory metal article and the setter block to a temperature above 2,200° F., and shrinking both the molded refractory metal article and the setter block by at least twenty percent (20%) during heating of the refractory metal article and the setter block.

44. A method as set forth in claim 39 wherein said step of sintering the molded refractory metal to form a refractory metal core includes forming the refractory metal core with at least a portion of the trailing edge portion of the refractory metal core having opposite sides separated by a distance of twelve thousandths of an inch (0.012 of an inch) or less as measured along an axis which is perpendicular to at least a portion of at least one of the sides of the refractory metal core.

45. A method as set forth in claim 44 wherein said step of forming the refractory metal core with at least a portion of the trailing edge portion of the refractory metal core having opposite sides separated by a distance of twelve thousandths of an inch (0.012 of an inch) or less includes forming at least one circular hole having diameter of three thousandths of an inch (0.003 of an inch) or less in said portion of the refractory metal core.

46. A method as set forth in claim 44 wherein said step of forming the refractory metal core with at least a portion of the trailing edge portion of the refractory metal core having opposite sides separated by twelve thousandths of an inch (0.012 of an inch) or less includes forming a plurality of circular holes having a diameter of three thousandths of an inch (0.003 of an inch) or less and separated by a distance which is equal to or less than the diameter of the holes.

47. A method as set forth in claim 39 wherein said step of shaping a body of refractory metal particles includes shaping a body of refractory metal powder having an average particle size of ten (10) to twenty (20) microns with the smallest particles having a particle size of less than one (1) micron.

48. A method as set forth in claim 39 wherein said trailing edge portion of said refractory metal core includes a plurality of circular holes having a diameter of three thousandths of an inch (0.003 of an inch) or less formed in a portion of the core having a thickness of twelve thousandths of an inch (0.012 of an inch) or less.

49. A method as set forth in claim 39 wherein said step of shaping a body of refractory metal particles to form a molded refractory metal article includes forming a plurality of holes which extend through the molded refractory metal article, said step of sintering the molded refractory metal article to form a refractory metal core includes forming the core with circular holes having a diameter which is one fourth (¼) or less of the thickness of a portion of the refractory metal core in which the holes are formed.

* * * * *